United States Patent [19]

Wada

[11] 4,328,762

[45] May 11, 1982

[54] MAGNETIC BRUSH DEVELOPING APPARATUS

[75] Inventor: Kenichi Wada, Sakai, Japan

[73] Assignee: Minolta Camera Kabushiki Kaisha, Osaka, Japan

[21] Appl. No.: 160,736

[22] Filed: Jun. 18, 1980

[30] Foreign Application Priority Data

Jul. 9, 1979 [JP] Japan ..... 54/87155

[51] Int. Cl.[3] ..... G03G 15/09; G03G 21/00

[52] U.S. Cl. ..... 118/652; 118/657; 355/3 DD

[58] Field of Search ..... 118/652, 657, 658; 355/3 DD

[56] References Cited

U.S. PATENT DOCUMENTS 3,943,887 3/1976 Smith ..... 118/657

3,982,498 9/1976 Wilcox ..... 118/658

*Primary Examiner*—Evan K. Lawrence

*Attorney, Agent, or Firm*—Wenderoth, Lind & Ponack

[57] ABSTRACT

A magnetic brush developing apparatus has a developing casing having a developer supply station and a developing station, a magnetic brush carrier member in the developing casing between the developer supply station and the developing station, and a magnet roller member rotatably mounted within the magnetic brush carrier member and driven in one direction for moving a developer in the form of a magnetic brush around the peripheral surface of the magnetic brush carrier member in a direction opposite the one direction from the developer supply station to the developing station. A scraping member is positioned along and contacting the portion of the peripheral surface of the magnetic brush carrier member extending in the opposite direction from the developing station, the scraping member having a scraping portion for scraping developer carried past the developing station from the magnetic brush carrier member for allowing it to fall away from the scraping member, and a guide portion extending from the scraping portion to the peripheral surface of the magnetic brush carrier member at a position spaced therealong in the one direction from the point where developer is scraped from the magnetic brush carrier member, the ends of the guide portion and the scraping portion remote from the magnetic brush carrier being connected and sufficiently close to the magnet roller member to allow developer not fallen away from the scraping member to flow therealong and back to the magnetic brush carrier member under the effect of the magnet roller member.

12 Claims, 2 Drawing Figures

MAGNETIC BRUSH DEVELOPING APPARATUS

BACKGROUND OF THE INVENTION

This invention relates to an apparatus for developing an electrostatic latent image, which has been generally employed in the field of electrophotography, and, more particularly, to a magnetic brush developing apparatus for use therein.

Conventionally, as a developer to be used for the above-described field is concerned, two-component developers such as a mixture constituted by magnetizable carrier particles, for example, iron particles, each having a relatively large particle-diameter (an approximate particle-diameter of 75 μm) and non-magnetizable particles, or one-component developers employing magnetizable toner particles and the like are well known in the art. These developers inherently have a number of advantages, but nevertheless have been used in practical applications up to the present. Recently, in order to further improve the above-described developers, thereby to provide them with much improved characteristics, there has been considerable research which has resulted in somewhat different novel developers. More specifically, there have been proposed two-component developers respectively constituted by magnetizable particles and non-magnetizable particles having approximately the same particle diameters as each other, which developers are disclosed, for instance, in U.S. Patent application Ser. No. 863,616, filed Dec. 23, 1977, Susumu TANAKA et al., U.S. Pat. No. 4,202,491, in which a developer constituted by magnetizable toner and electrically insulating non-magnetizable toner at a predetermined mixing ratio by weight is employed as the developer, and also in U.S. Patent Application Ser. No. 949,426, filed Oct. 5, 1978, Kenji TABUCHI et al. in which there is employed a developer constituted by insulating toner particles and carrier particles having the properties of (1) being magnetic, (2) having a high electroresistivity (more than $10^{12}$ Ω·cm), and (3) being 5 to 40 μm in size.

Actually, although the respective, improved two-component developers as described above are capable of being used in a conventional magnetic brush developing apparatus without any important modification in the apparatus, some properties of the recently improved two-component developers described above are somewhat different from those of the conventional developers. Therefore, if the recently improved developers are employed for the developing process, the magnetic brush developing apparatus itself should be arranged to be applicable to such improved developers.

In order to be able to take advantage of the properties of such improved developers, there has been proposed by the present inventor a magnetic brush developing apparatus, as shown in FIG. 1, for which U.S. Patent application Ser. No. 74,812 was filed on Sept. 11, 1979 in the name of Kenji TABUCHI et al., which has not yet been laid open to public inspection in the U.S.A. and is different from the present invention which relates to an improvement thereof.

Referring to FIG. 1 showing the main portion of the magnetic brush developing apparatus disclosed in the above U.S. Patent application Ser. No. 74,812, the general construction and function thereof are briefly described hereinbelow.

The magnetic brush developing apparatus is enclosed by an upper casing 4, a lower casing 6 and a pair of side walls W which constitute a developing casing, and generally comprises a developing sleeve 2, and a multipolar magnet member 3 rotatably enclosed in the developing sleeve 2. The developing sleeve 2 has a cylindrical configuration and is made of non-magnetizable electrically conductive material such as aluminum and is disposed for rotation counterclockwise in the direction of the arrow "b" at 30 r.p.m. in a position close to the surface 1*a* of a photoreceptor drum 1 which is also capable of rotating counterclockwise in the direction of the arrow "a". The multipolar magnet member 3 has a roll-like configuration and has magnetic poles N and S sequentially arranged around the outer periphery with alternately different polar orientation as shown and is adapted to rotate at a high speed of 1,300 r.p.m. in the same direction as that of the rotation of the developing sleeve 2, i.e. in the direction indicated by the arrow "c" in FIG. 1. Accordingly, the developer is subjected to one certain specific moving speed in the direction of the arrow "b" due to the rotation of the developing sleeve 2 and also to another certain specific moving speed in the direction opposite that of the arrow "c" with respect to the developing sleeve 2 by the rotation of the multipolar magnet member 3 and is consequently moved along the peripheral surface of the developing sleeve 2 in the direction indicated by the arrow "d" at a speed which is the difference between the above-described two rotational speeds. In a position above the developing sleeve 2, there is provided a casing member 4*a*, which is suitably connected to the upper casing 4 so as to constitute a portion of the upper casing 4, and an inner surface 4*b* of the casing member 4*a* is shaped in an arcuate form so that the magnetic brush fromed on the peripheral surface of the developing sleeve 2 will effectively be in close contact with said inner surface 4*b*. Meanwhile, at a leading edge of the casing member 4*a* and on a line extending from the arcuate inner surface 4*b*, an electrically insulative sealing member 5 of resilient material is provided so as to contact the surface 1*a* of the photoreceptor drum 1. In a position below the developing sleeve 2, there are provided a lower enclosing member 7, a developer-trapping member 8, a supplementary cleaning member 9 the free end portion of which is directed in a direction opposite the direction of rotation of the developing sleeve 2, a scraping member 10 the free end portion of which is directed in a direction the same as the direction of rotation of the developing sleeve 2, a cleaning member 11 the free end portion of which is directed in a direction opposite the direction of rotation of the developing sleeve 2, and a bucket roller 12 having a plurality of trough-like members 12' provided around its peripheral surface for supplying the developer to the developing sleeve 2, and which is driven for rotation in the direction indicated by the arrow "e". The lower enclosing member 7 is impressed with a bias voltage having the same polarity as that of the electrostatic latent image, while the developer trapping member 8 is suitably grounded.

By the arrangement as described in the foregoing, the developer is first transported clockwise by the plurality of trough-like members 12' of the bucket roller 12, until the developer reaches a position (A) whereat the developer is affected by the magnetic force of the multipolar magnet member 3. At the position (A), the trough-like members 12' are turned over thereby to pour the developer toward the developing sleeve 2, whereby the developer is moved in the direction of the arrow "d"

along the peripheral surface of the developing sleeve 2, with the developer taking the form of a magnetic brush on the developing sleeve 2. In accordance with the clockwise movement of the developer, in the form of the magnetic brush, the developer is in rubbing contact with the electrostatic latent image which has already been formed on the photoreceptor surface in a known manner so that the developer is used for developing the electrostatic latent image on the photoreceptor surface. After having accomplished the developing step, the developer is further moved in the direction of the arrow "d" and then scraped off the peripheral surface of the developing sleeve 2 by the scraping member 10 and is stirred and mixed by a developer stirring mechanism (not shown). Thereafter, similar movements of the developer are repeated by the operation of the bucket roller 12.

The foregoing description relates to the magnetic brush developing apparatus proposed by the present inventors and disclosed in the U.S. Patent application Ser. No. 74,812 mentioned earlier.

In the various developing experiments carried out by the present inventors over a long period on the above magnetic brush developing apparatus for detailed analysis of its adaptability with respect to the developer described earlier, favorable results have been confirmed in many respects. However, it has also been observed that said magnetic brush developing apparatus still has some deficiencies as follows. It is to be noted that, for the above experiments, the developer disclosed in the U.S. Patent application Ser. No. 949,426 mentioned earlier was employed.

More specifically, upon repetition of the developing experiments over a long term on the above magnetic brush developing apparatus, it was observed that, at the side of the scraping member 10 remote from the developing sleeve 2, i.e. at a position (B) shown in FIG. 1, an accumulation or pool of stagnant developer was gradually formed, which hindered the movement of the developer at the developing section. According to the analysis made by the present inventors, the formation of the pool of developer is surmised to be mainly attributable to the fact that, since the developer at the position (B) is subjected to a magnetic force exerted upwardly in FIG. 1 due to the magnetic action of the multipolar magnet member 3 which is balanced by gravity exerted downwardly in FIG. 1 by the weight of the developer itself, it is extremely difficult for the developer to be subjected to the moving force due to the rotation of the multipolar magnet member 3, and said developer can not readily be moved at the position (B). The obstruction to the smooth movement of developer at the developing section as described above also tends to bring about such disadvantages as occurrence of fogging in the resultant images after the development, and conspicuous scattering of the developer out of the developing apparatus through the gap between the surface 1*a* of the photoreceptor drum 1 and the lower closing member 7.

SUMMARY OF THE INVENTION

Accordingly, an essential object of the present invention is to provide a magnetic brush developing apparatus in which formation of a pool of stagnant developer is eliminated, with consequent overcoming of the problems related to occurrence of fogging in the copied images, scattering of developer, etc.

Another important object of the present invention is to provide a magnetic brush developing apparatus of the above described type, which has a specifically novel construction and, is highly efficient in use.

A further object of the present invention is to provide a magnetic brush developing apparatus of the above-described type, which is specifically designed to use a developer constituted by non-magnetizable particles and magnetizable particles.

A still further object of the present invention is to provide a magnetic brush developing apparatus of the above-described type, which is arranged to be specifically adaptable for an electrophotographic copying machine.

In accomplishing these and other objects, according to one preferred embodiment of the present invention, there is provided a magnetic brush developing apparatus for use in an electrophotographic copying apparatus which includes a developing casing, a magnetic brush carrier member or developing sleeve rotatably provided in the developing casing, a magnet roller member rotatably enclosed in the magnetic brush carrier member driven for rotation at a predetermined high speed in a direction opposite to the direction of movement of the developer during development, and a scraping member having a triangular cross section provided to contact the lower peripheral surface of the magnetic brush carrier member at a position following the developing section in the direction of movement of the developer. The scraping member further includes a scraping portion for scraping the developer used for the development off the peripheral surface of the magnetic brush carrier member so as to cause most of the developer to fall or drop downward due to its weight, and a guide portion for leading the developer which does not drop toward the peripheral surface of the magnetic brush carrier member through magnetic action of the magnet roller member.

By the arrangement according to the present invention as described above, an improved magnetic brush developing apparatus which does not cause the undesirable formation of a pool or accumulation of developer is advantageously provided which substantially eliminates the disadvantages inherent in the conventional arrangements of this kind.

BRIEF DESCRIPTION OF THE DRAWING

These and other objects and features of the present invention will become apparent from the following description of the preferred embodiment thereof taken together with the accompanying drawings, in which.

Before the description of the present invention proceeds, it is to be noted that like parts are designated by like reference numerals throughout FIGS. 1 and 2, with a detailed description of FIG. 2 being abbreviated for brevity.

DETAILED DESCRIPTION OF THE INVENTION

Figure 1:
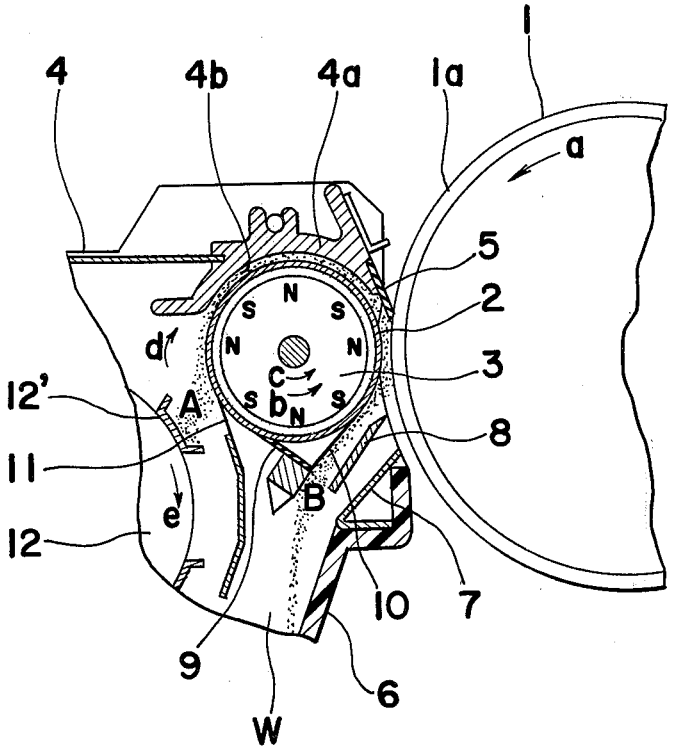
FIG. 1 is a fragmentary side sectional view showing an essential portion of a magnetic brush developing apparatus formerly proposed by the present inventors, but not constituting prior art for the present invention (already referred to)
Figure 2:
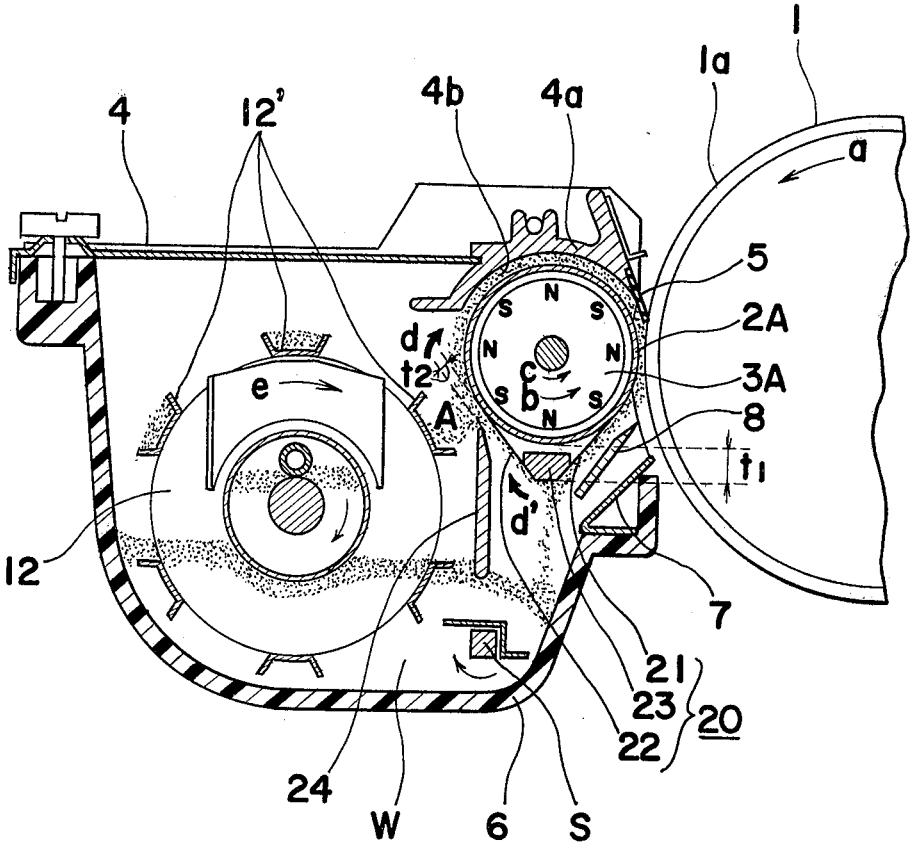
FIG. 2 is a side sectional view of an improved magnetic brush developing apparatus according to one preferred embodiment of the present invention.

Referring to FIG. 2, the improved magnetic brush developing apparatus is enclosed by the upper casing 4, casing member 4*a*, lower casing 6, and opposite side walls W for the developing casing, and comprises a magnetic brush carrier member or developing sleeve 2A, and a magnet roller member or multipolar magnet member 3A rotatably provided in the developing sleeve 2A in a manner generally similar to the arrangement of FIG. 1. The developing sleeve 2A for carrying, on the outer periphery thereof, the magnetic brush formed by the developer in the manner as described with reference to FIG. 1 and causing the magnetic brush to rub against the electrostatic latent images formed on the surface 1*a* of the photoreceptor drum 1 for developing the latent images into visible images, is rotatably driven at 30 r.p.m. in the direction indicated by the arrow "b" during development and non-development periods of the latent images. It is to be noted, however, that the driving of the developing sleeve 2A is interrupted after said developing sleeve 2A has been rotated for a predetermined period of time (approximately for 20 seconds) during the non-development period subsequent to the developing of the electrostatic latent images. Meanwhile, the multipolar magnet member 3A provided in the developing sleeve 2A is driven for a high speed rotation at 1,300 r.p.m. in the direction of the arrow "c" only during the development of the electrostatic latent images. Consequently, the developer is moved along the peripheral surface of the developing sleeve 2A in the direction of the arrow "d" during the development of the latent images, and in the direction opposite to the arrow "d" during the non-development period.

It is to be noted here that the electrostatic latent image development period described above is the period during which at least the electrostatic latent images to be developed pass through the developing section, while the non-development period is the period other than the above development period, and more specifically, the period during which the electrostatic latent images to be developed are not present at the developing section. It should also be noted that the developing section is the portion where the surface of the developing sleeve 2A comes close to the surface 1*a* of the photoreceptor drum 1, and where the peripheral surface 1*a* of the drum 1 is rubbed by the developer in the form of the magnetic brush formed on the peripheral surface of the developing sleeve 2A.

In a position below the developing sleeve 2A, there is provided a scraping member 20 having a generally triangular cross section and for contacting the lower portion of the peripheral surface of the developing sleeve 2A. The scraping member 20 further includes a scraping portion or scraping element 21 which scrapes the developer off the sleeve after the developer has been rubbed against the photoreceptor surface 1*a*, i.e. after having been used for the development, for causing the scraped off developer to fall downward due to the weight of the developer itself, and a guide portion or guide member 22 for leading the remaining developer toward the peripheral surface of the developing sleeve 2A by the magnetic action of the multipolar magnet member 3A. More specifically, the above scraping element 21 is made of a Mylar (name used in trade and produced by Du Pont Co., Ltd., U.S.A.) sheet 50 μm thick and extends across the apparatus and is secured, at its one edge, to a support rod 23 and contacting at its other edge the peripheral surface of the developing sleeve 2A. The scraping element 21 guides the developer scraped off the peripheral surface of the developing sleeve 2A to a position spaced a distance $t_1$ from said peripheral surface. The distance $t_1$ is set such that it is sufficient to cause most of the developer scraped off the peripheral surface of the developing sleeve 2A by the scraping element 21 to fall or drop downward due to the weight of the developer and inertia from the movement of the developer, etc. during the electrostatic latent image development period, and that the magnetic action of the multipolar magnet member 3A sufficiently influences the developer which does not drop. Although the distance $t_1$ as described above should be properly determined according to the composition of the developer itself, magnetic force of the multipolar magnet member 3A, etc., and therefore, the optimum value thereof can not generally be given, it is set to be 8 mm in the disclosed embodiment. It should be noted here that in the above embodiment, the multipolar magnet member 3A has a magnetic force of 1,000 gauss, and that the developer employed therein is a mixture of electrically insulative non-magnetizable toner and high resistance magnetizable carrier particles of small diameter disclosed in the U.S. Patent application Ser. No. 949,426 mentioned earlier. On the other hand, the guide portion 22 is made of a phosphor bronze sheet 50 μm thick secured, at its one edge, to the support rod 23 and contacting, at its other edge, the peripheral surface of the developing sleeve 2A. The phosphor bronze sheet guides the remaining developer which does not fall downward, onto the peripheral surface of the developing sleeve 2A by the magnetic action of the multipolar magnet member 3A. More specifically, following the rotation of the multipolar magnet member 3A, the remaining developer as described above is moved in the direction of the arrow "d'" along the surfaces of the support rod 23 and guide portion 22 by the magnetic action of the magnet member 3A and thus reaches the peripheral surface of the developing sleeve 2A. The guide portion 22 also functions to scrape off the peripheral surface of the developing sleeve 2A developer moving in the direction opposite to the arrow "d" from the developer supplying section (A).

Between the support rod 23 and the developer supplying section (A) there is provided a guide plate 24 in spaced relation from the peripheral surface of the developing sleeve 2A by a very small clearance $t_2$ as shown. The guide plate 24 functions as follows:

(i) During the electrostatic latent image development, it functions to prevent movement of a large amount of developer in the direction opposite to the direction of the arrow "d" from the developer supplying section (A) toward the scraping member 20 as the developer is subjected to the moving force due to rotation of the developing sleeve 2A instead of being subjected to the moving force due to rotation of the multipolar magnet member 3A, because of excessive supplying, etc. of the developer onto the peripheral surface of the developing sleeve 2A at the developer supplying section (A) (such excessive supplying takes place when the trough-like members 12' of the bucket roller 12 come closest to the peripheral surface of the developing sleeve 2A), and simultaneously, to allow the developer moving in the direction of the arrow "d'" from the scraping member 20 to move toward the developer supplying section (A).

(ii) During the non-development period, it functions to prevent movement of a large amount of developer in the direction opposite to the arrow "d" from the developer supplying section (A) toward the scraping member 20, by being carried along by the rotation of the developing sleeve 2A which is the only member rotating at this time.

(iii) Also, it functions to assist in the elimination of an adverse effect on the guide portion 22 due to the arrival of a larger amount of developer at the guide portion 22 of the scraping member 20.

With the above arrangement, the movement of the developer in the foregoing embodiment will be as described hereinbelow.

During the electrostatic latent image developing period, the developer moves in the direction of the arrow "d" along the peripheral surface of the developing sleeve 2A due to the rotation of both the developing sleeve 2A and the multipolar magnet member 3A. In the above case, as the developer is supplied to the developing sleeve 2A from the trough-like members 12' at the developer supplying section (A), there is a slight amount of the developer which tends to move in the direction opposite to the arrow "d" due to a moving force arising from rotation of the developing sleeve 2A instead of the moving force arising from the multipolar magnet member 3A, when there is an excessive supplying of the developer, etc. as described earlier. However, this slight amount of the developer is prevented from reaching the developing section by the action of the guide plate 24 and scraping member 20. More specifically, the movement of most of the slight amount of developer as described above is obstructed by the guide plate 24, while the developer which is unobstructed is scraped off the peripheral surface of the developing sleeve 2A by the guide portion 22 of the scraping member 20, and caused to fall downward due to the weight of the developer itself and the inertia force from the movement of the developer. Some of such developer will be subjected to the moving force due to the rotation of the multipolar magnet member 3A, for example, due to reduction in the absolute amount of the developer moved in the direction opposite to the arrow "d" following the fall of the developer as described earlier, and is consequently moved in the direction of the arrow "d" so as to be returned to the peripheral surface of the developing sleeve 2A, and thus it reaches the developer supplying section (A) through the clearance $t_2$ between the guide plate 24 and the developing sleeve 2A.

It should be noted here that the supply of an excess of the developer as described above takes place only when the trough-like members 12' of the bucket roller 12 come closest to the peripheral surface of the developing sleeve 2A, and therefore occurs intermittently during rotation of said bucket roller 12, and therefore, that developer moving in the direction opposite to the arrow "d" is not always present.

The developer moving in the direction of the arrow "d" along the peripheral surface of the developing sleeve 2A reaches the developing section, and rubs against the surface 1*a* of the photoreceptor drum 1 in the form of the magnetic brush for developing the electrostatic latent images formed on the surface 1*a*. The developer thus used for the developing further moves in the direction of the arrow "d" and reaches the scraping element 21 of the scraping member 20, whereat the developer is scraped off the peripheral surface of the developing sleeve 20 and most of it is caused to fall downward due to the weight thereof and the inertia force from its movement. The developer which does not fall is moved in the direction of the arrow "d'" along the peripheral surface of the support rod 23 and guide portion 22 and is led onto the peripheral surface of the developing sleeve 2A, and then reaches the developer supplying section (A) through the clearance $t_2$ between the guide plate 24 and developing sleeve 2A.

It is to be noted here that, in the case where there is developer moving in the direction opposite to the arrow "d" following an excessive supplying of the developer, the developer moving in the direction opposite to the arrow "d" and scraped off the peripheral surface of the developing sleeve 2A by the guide portion 22 of the scraping member 20, and the developer moving in the direction of the arrow "d'" collide with each other, and quite easily fall downward due to being subjected to the physical force produced upon such a collision.

Subsequently, during the non-development period, the developer moves in the direction opposite to the arrow "d" due to rotation of the developing sleeve 2A in the direction of the arrow "b" after interruption of rotation of the multipolar magnet member 3A, whereby the developer present in the developing section is returned to the developer supplying section (A), and thus, during the non-development period, the surface 1*a* of the photoreceptor drum 1 is prevented from being unnecessarily rubbed by the developing material in the form of the magnetic brush. It is to be noted here that the developer moved in the direction opposite to the arrow "d" from the developer supplying section (A) is prevented from reaching the developing section by the action of the guide plate 24 and scraping member 20.

During the electrostatic latent image development period or non-development period, the developer caused to fall below the developing sleeve 2A by the action of the scraping member 20 is mixed and stirred by the developer stirring mechanism S rotatably provided adjacent to the lower casing 6 in FIG. 2, and is continuously supplied to the peripheral surface of the developing sleeve 2A by the bucket roller 12 for repeatedly being used for the development.

Since the construction and function of the developer stirring mechanism S are described in detail in the U.S. Patent application Ser. No. 74,812 mentioned earlier, a detailed description thereof is omitted here for brevity.

As is clear from the foregoing description, the magnetic brush developing apparatus according to the present invention includes the magnetic brush carrier member, i.e. developing sleeve 2A, the multipolar magnet roller 3A rotatably enclosed in the developing sleeve 2A and driven for rotation at a high speed in the direction opposite to the direction of movement of the developer during the development, and the scraping member 20 having the triangular cross section and contacting the lower peripheral surface of the developing sleeve 2A at a position past the developing section in the direction of movement of the developer, and said scraping member 20 further includes the scraping element 21 for scraping the developer used for the development off the developing sleeve 2A so as to cause most of the developer to fall downward due to its weight, and the guide portion 22 for leading the developer which does not fall toward the peripheral surface of the developing sleeve due to the magnetic action of the multipolar magnet member 3A. Accordingly, various drawbacks such as occurrence of fogging, formation of the pool of developer and scattering of the developer, etc. have been advantageously eliminated. More specifically, the magnetic brush developing apparatus according to the present invention does not cause the undesirable formation of the accumulation or pool of the developer after it is scraped off the peripheral surface of the developing sleeve 2A, due to the phenomenon inherent in the above arrangement that the developer is led onto the peripheral surface of said developing sleeve by the magnetic action of the multipolar magnet member and moved along the developing sleeve.

Although the present invention has been fully described by way of example with reference to the accompanying drawings, it is to be noted that various changes and modifications will be apparent to those skilled in the art. Therefore, unless otherwise, such changes and modifications depart from the scope of the present invention, they should be contrued as being included therein.

What is claimed is:

1. A magnetic brush developing apparatus which comprises:

a developing casing having a developer supply station and a developing station;

a magnetic brush carrier member in said developing casing between said developer supply station and said developing station;

a magnet roller member rotatably mounted within said magnetic brush carrier member and having means for rotating said magnet roller member in one direction for moving a developer in the form of a magnetic brush around the peripheral surface of said magnetic brush carrier member in a direction opposite to said one direction from the developer supply station to said developing station; and a scraping member positioned along and contacting the lower portion of the peripheral surface of said magnetic brush carrier member extending in said opposite direction from said developing station, said scraping member having a scraping portion for scraping developer carried past said developing station from the magnetic brush carrier member for allowing it to fall away from said scraping member, and a guide portion extending from said scraping portion to the peripheral surface of said magnetic brush carrier member at a position spaced therealong in said opposite direction from the point at which the developer is scraped from the magnetic brush carrier member, the ends of said guide portion and said scraping portion remote from said magnetic brush carrier member being connected and being sufficiently close to said magnet roller member for allowing a flow of developer therealong which has not fallen away from said scraping member to flow back to said magnetic brush carrier member under the effect of said magnet roller member.

2. A magnetic brush developing apparatus as claimed in claim 1 in which the point at which said remote ends of said guide portion and said scraping portion are connected is at the lowest part of said scraping member.

3. A magnetic brush developing apparatus as claimed in claim 1, wherein said magnetic brush carrier member is a rotatable developing sleeve made of non-magnetizable electrically conductive material and further having rotating means for rotating said developing sleeve in the same direction as the direction of rotation of said magnet roller member.

4. A magnetic brush developing apparatus as claimed in claim 3, wherein said magnet roller member is a multipolar magnet, and said rotating means therefor is rotating means for rotating said magnet roller member at high speed in comparison with the rotation speed of said magnetic brush carrier member.

5. A magnetic brush developing apparatus as claimed in claim 1, wherein said scraping portion of said scraping member has one end contacting the peripheral surface of the magnetic brush carrier member and extending in a direction toward the developing station.

6. A magnetic brush developing apparatus as claimed in claim 1, wherein said scraping portion of said scraping member is a thin and resilient sheet extending from the magnetic brush carrier member to the point where it is connected to said guide portion.

7. A magnetic brush developing apparatus as claimed in claim 6, wherein said point where said guide portion and said scraping portion are connected is about 8 mm from the peripheral surface of said magnetic brush carrier member.

8. A magnetic brush developing apparatus as claimed in claim 1, wherein said guide portion of said scraping member is a thin and resilient sheet extending toward the peripheral surface of said magnetic brush carrier member.

9. A magnetic brush developing apparatus as claimed in claim 1, further including a guide member positioned between said scraping member and the developer supply station for preventing movement of the developer from the developer supply station toward the scraping member along the peripheral surface of the magnetic brush carrier member.

10. A magnetic brush developing apparatus as claimed in claim 9, wherein said guide member is spaced from the peripheral surface of said magnetic brush carrier member to allow the developer to move from said scraper member toward said developer supply station along the peripheral surface of said magnetic brush carrier member.

11. A magnetic brush developing apparatus as claimed in claim 10, wherein said guide member is a plate-like member having a forward edge spaced a predetermined distance from the peripheral surface of said magnetic brush carrier member.

12. A magnetic brush developing apparatus as claimed in claim 1, wherein said magnetic brush carrier member is rotatably mounted in said developing casing and further having rotating means for rotating said magnetic brush carrier in the same direction as the direction of rotation of said magnet roller member at a rotational speed lower than the speed of movement of the developer with respect to the peripheral surface of the magnetic brush carrier member arising from the rotation of said magnet roller member.

* * * * *